US007909695B2

(12) United States Patent
Phelps, Jr. et al.

(10) Patent No.: US 7,909,695 B2
(45) Date of Patent: Mar. 22, 2011

(54) SYSTEM AND METHOD FOR INTERACTIVE ENTERTAINMENT

(75) Inventors: William G. Phelps, Jr., Dobbs Ferry, NY (US); Steven W. Wright, Baltimore, MD (US); Lauren M. McBride, Dobbs Ferry, NY (US)

(73) Assignee: Idea Storm Products, LLC, Dobbs Ferry, NY (US)

( * ) Notice: Subject to any disclaimer, the term of this patent is extended or adjusted under 35 U.S.C. 154(b) by 896 days.

(21) Appl. No.: 11/835,120

(22) Filed: Aug. 7, 2007

(65) Prior Publication Data

US 2009/0042648 A1 Feb. 12, 2009

(51) Int. Cl.
*A63F 9/24* (2006.01)
*A63F 3/00* (2006.01)

(52) U.S. Cl. ..... 463/31; 273/244.2; 273/272; 273/275; 273/299

(58) Field of Classification Search ..... 463/31, 463/9; 273/244.2, 272, 275, 299
See application file for complete search history.

(56) References Cited

U.S. PATENT DOCUMENTS 4,682,777 A 7/1987 Wood
5,547,199 A 8/1996 Calhoun
5,921,864 A 7/1999 Walker et al.
6,196,549 B1 3/2001 Bennett
6,450,499 B1 9/2002 Letang
6,454,262 B1 9/2002 Wilt et al.
2002/0119812 A1 8/2002 Letang
2002/0125637 A1 9/2002 Leis
2004/0188941 A1 9/2004 Levin
2005/0082759 A1 4/2005 Strahan
2006/0202421 A1 9/2006 Hurwitz
2006/0261554 A1 11/2006 Hammer
2007/0018393 A1 1/2007 Ritter et al.

*Primary Examiner* — Dmitry Suhol
*Assistant Examiner* — Malina K Rustemeyer
(74) *Attorney, Agent, or Firm* — Lackenbach Siegel, LLP; Andrew F. Young

(57) ABSTRACT

The present invention relates to a system and a method for interactive entertainment involving a game. More specifically, the present invention relates to a method for playing a game involving interactive generation of a visual image and a lingual definition of a precursor constructed phrase and image portion by a plurality of participant-users, and a method and system for sharing the same via a world wide interactive computer system. The computer system enables different participant-users, or teams of participant-users, to post generated visual and lingual definitions for the same precursor constructed phrase and image portions enabling comparison entertainment of the same and supporting selection of a preferred construction for awarding a prize.

15 Claims, 6 Drawing Sheets

(SINGLE USER)

(MULTIPLE USER)

SYSTEM AND METHOD FOR INTERACTIVE ENTERTAINMENT

BACKGROUND OF THE INVENTION

1. Field of the Invention

The present invention relates to a system and a method for interactive entertainment involving a game. More specifically, the present invention relates to a method for playing a game involving interactive generation of a visual image and a lingual definition of a precursor constructed phrase and image portion, and for sharing the same via a world wide interactive computer system.

2. Description of the Related Art

The related art involves interactive drawing games such as Pictionary®, which operates as a word guessing board game and provides therefore a board-game form of a hosted entertainment system for groups or teams. The Pictionary® game is played by teams with players trying to identify specific conventional or understood words from their teammates' drawings. The team chooses one person to do the drawing; this position rotates with each word. The person-drawer chooses a conventional card out of a deck of special Pictionary-cards and tries to draw pictures which suggest the word printed on the card. A timer is required for play and use to determine a winning team. The pictures cannot contain any numbers or letters. The teammates try to guess the word the drawing is intended to represent. In each case the game play is based upon a rigid set of team rules, requires the use of a previously defined and known word, and cannot be played individually. See for example http://en.wikipedia.org/wiki/Pictiongy, the entire contents of which are herein incorporated by reference. Pictionary however fails to appreciate (a) the entertainment needs of the individual (the game cannot be played individually), (b) the detrimental impact of required winning (by a time clock, etc.), and (c) fails to capitalize on the benefits of imaginative generation and whimsy allowing different results for different users (Pictionary has only one "correct" answer no matter the drawing generated to be the definition, and the definition is required to be that conventionally recognized in the language of play (English, etc.))

Also known in the related are participant games that include the generation of a story-book type image based upon a known descriptive phrase containing recognizable and previously defined words.

What is not appreciated by the related art is the need for an entertainment system and method involving participation in generating a visual image and constructing a full lingual definition based upon a provided non-defined phrase and an image portion.

What is also not appreciated by the related art is the need for a method of playing an entertainment system involving image and lingual definition related to previously undefined phrases or words by a plurality of participant-users or comparing a generating result with others via a world-wide interactive computer system allowing selection of a preferred construction by random (system) selection or participant (popularity) selection.

What is also not appreciated by the related art is the concept for a board game, or electronic interaction game, wherein an initial construction phrase is provided, and an image portion selector (by drawing cards containing images or by rolling a die having multiple drawing image sides) is used to provide an initially created image portion, whereafter a user or users generate completed visual and lingual definitions for the initially constructed phrase.

Finally, what is not appreciated by the related art is the need for an entertainment method and system that does not require competition (individual or team) for enjoyment but may be adapted to competitive play and operation.

Accordingly, there is a need for an improved method and system for interactive entertainment involving image construction and lingual definition.

OBJECTS AND SUMMARY OF THE INVENTION

An object of the present invention is to provide a solution to at least one of the needs noted above.

Another object of the present invention is to provide an entertainment system and method involving participation in generating a visual image and a lingual definition of a precursor constructed phrase and image portion.

Another object of the present invention is to provide a method of playing an entertainment system involving image and lingual definition by a plurality of participant-users or comparing a generating result with others via a world-wide interactive computer system allowing selection of a preferred construction by random (system) selection or participant (popularity) selection.

Another object of the present invention is to provide a board game, or an electronic interaction game, wherein an initial construction phrase is provided, and an image portion selector (by drawing cards containing images or by rolling a die having multiple drawing image sides) is used to provide an initially created image portion, whereafter a user or users generate completed visual and llingual definitions for the initially constructed phrase.

The present invention relates to a system and a method for interactive entertainment involving a game. More specifically, the present invention relates to a method for playing a game involving interactive generation of a visual and a lingual definition of a precursor constructed phrase and image portion, and for sharing the same via a world wide interactive computer system.

The present invention also relates to a method for playing a game involving interactive generation of a visual image and a lingual definition of a precursor constructed phrase and image portion by a plurality of participant-users, and a method and system for sharing the same via a world wide interactive computer system. The computer system also enables different participant-users, or teams of participant-users, to post generated visual and lingual definitions for the same precursor constructed phrase and image portions enabling comparison entertainment of the same and supporting selection of a preferred construction for awarding a prize.

According to an embodiment of the present invention there is provided a method for interactive entertainment of at least one participant-user, comprising the steps of: providing a precursor constructed phrase and an image portion on a media for participation, reading the precursor constructed phrase, generating a definition of the precursor constructed phrase, and the step of generating the definition further comprising the steps of: drawing at least an illustration of the definition including the image portion, and writing at least a first portion of the definition of the precursor constructed phrase, wherein the steps of drawing and writing are linked to depict the definition of the precursor constructed phrase.

According to another alternative embodiment of the present invention there is provided a method further comprising the steps of: providing an interactive computer system having a centralized platform for hosting a plurality of definitions of the precursor constructed phrases from a plurality of different participant-users, accessing the interactive computer system, submitting at least one of the plurality of definitions of the precursor constructed phrase to the centralized platform, and enabling an access to the submitted at least one definition.

According to another alternative embodiment of the present invention there is provided a method further comprising the steps of: providing a means for selecting a preferred definition of the precursor constructed phrase among the plurality of definitions, and the means for selecting including at least one of a means for participant-user popularity selection and a means for random participant-user selection.

According to another alternative embodiment of the present invention there is provided a method further comprising the steps of: providing a means for delivering an award to the participant-user who submitted the preferred definition of the precursor constructed phrase according to the means for selecting.

According to another alternative embodiment of the present invention there is provided a method wherein: the step of generating the definition of the precursor constructed phrase includes at least two participant-users.

According to another alternative embodiment of the present invention there is provided a method wherein: the step of drawing further comprises: at least a first step of drawing at least a portion of the illustration by the at least one participant-user as a first user and at least a second step of drawing a second portion of the illustration by the at least second participant-user, whereby the method for interactive entertainment enables use by multiple participant-users.

According to another alternative embodiment of the present invention there is provided a method wherein: the step of writing further comprises: at least a first step of writing the at least first portion of the definition by the at least one participant-user as a first user and at least a second step of writing at least a second portion of the definition by the at least second participant-user, whereby the method for interactive entertainment enables use by multiple participant-users.

According to another alternative embodiment of the present invention there is provided a method wherein: the step of generating the definition of the precursor constructed phrase includes at least two participant-users, the step of writing further comprises: at least a first step of writing the at least first portion of the definition by the at least one participant-user as a first user and at least a second step of writing at least a second portion of the definition by the at least second participant-user, and at least a first step of drawing at least a portion of the illustration by the at least one participant-user as a first user and at least a second step of drawing a second portion of the illustration by the at least second participant-user, whereby the method for interactive entertainment enables use by multiple participant-users.

According to another alternative embodiment of the present invention there is provided a method wherein: the media for participation comprises at least one of a written pad, a printed paper pad, a non-networked electronic memory device, and a networked electronic memory device.

According to another alternative embodiment of the present invention there is provided a method for interactive entertainment of at least one participant-user, comprising the steps of: providing a precursor constructed phrase and an image portion on a media for participation, reading the precursor constructed phrase, generating a definition of the precursor constructed phrase, the step of generating the definition further comprising the steps of: drawing at least an illustration of the definition including the image portion, and writing at least a first portion of the definition of the precursor constructed phrase, wherein the steps of drawing and writing are linked to depict the definition of the precursor constructed phrase, providing an interactive computer system having a centralized platform for hosting at least one of a plurality of definitions of the precursor constructed phrases the participant-users, accessing the interactive computer system, submitting at least one of the plurality of definitions of the precursor constructed phrase to the centralized platform, and enabling an access to the submitted at least one definition for at least a visual review.

According to another alternative embodiment of the present invention there is provided a method wherein: the step of generating the definition of the precursor constructed phrase includes at least two participant-users.

According to another alternative embodiment of the present invention there is provided a method wherein: the step of drawing further comprises: at least a first step of drawing at least a portion of the illustration by the at least one participant-user as a first user and at least a second step of drawing a second portion of the illustration by the at least second participant-user following a passing of the media for participation to the first user, whereby the method for interactive entertainment enables use by multiple participant-users.

According to another alternative embodiment of the present invention there is provided a method wherein: the step of writing further comprises: at least a first step of writing the at least first portion of the definition by the at least one participant-user as a first user and at least a second step of writing at least a second portion of the definition by the at least second participant-user, whereby the method for interactive entertainment enables use by multiple participant-users.

According to another alternative embodiment of the present invention there is provided a method wherein: the step of generating the definition of the precursor constructed phrase includes at least two participant-users, the step of writing further comprises: at least a first step of writing the at least first portion of the definition by the at least one participant-user as a first user and at least a second step of writing at least a second portion of the definition by the at least second participant-user, and at least a first step of drawing at least a portion of the illustration by the at least one participant-user as a first user and at least a second step of drawing a second portion of the illustration by the at least second participant-user, whereby the method for interactive entertainment enables use by multiple participant-users.

According to another alternative embodiment of the present invention, a kit is provided for interactive entertainment for a plurality of participant-users, comprising: means for generating a plurality of precursor constructed phrases and associated image portions and for recording the same on at least one media for participation, the at least one media for participation containing indicia for receiving multiple writings from respective participant-users providing a generated definition of the precursor constructed phrase and a located region proximate the associated image portions for receiving multiple drawings from the respective participant-users, container means for containing the at least one media for participation, and instruction indicia means for providing participation instructions.

According to another embodiment of the present invention, there is provided a system for interactive entertainment of at least one participant-user, comprising: means for generating a precursor constructed phrase and an image portion on a media for participation, means for reading the precursor constructed phrase by the at least one participant-user, means for generating a definition of the precursor constructed phrase, the means for generating the definition further comprising: means for drawing at least an illustration of the definition including the image portion, and means for writing at least a first portion of the definition of the precursor constructed phrase, wherein the means for drawing and writing are linked to depict the definition of the precursor constructed phrase.

According to another embodiment of the present invention, a system for interactive entertainment is provided, further comprising: means for providing an interactive computer system having a centralized platform for hosting a plurality of definitions of the precursor constructed phrases from a plurality of different participant-users, means for accessing the interactive computer system, means for submitting at least one of the plurality of definitions of the precursor constructed phrase to the centralized platform, and means enabling an access to the submitted at least one definition.

The above, and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
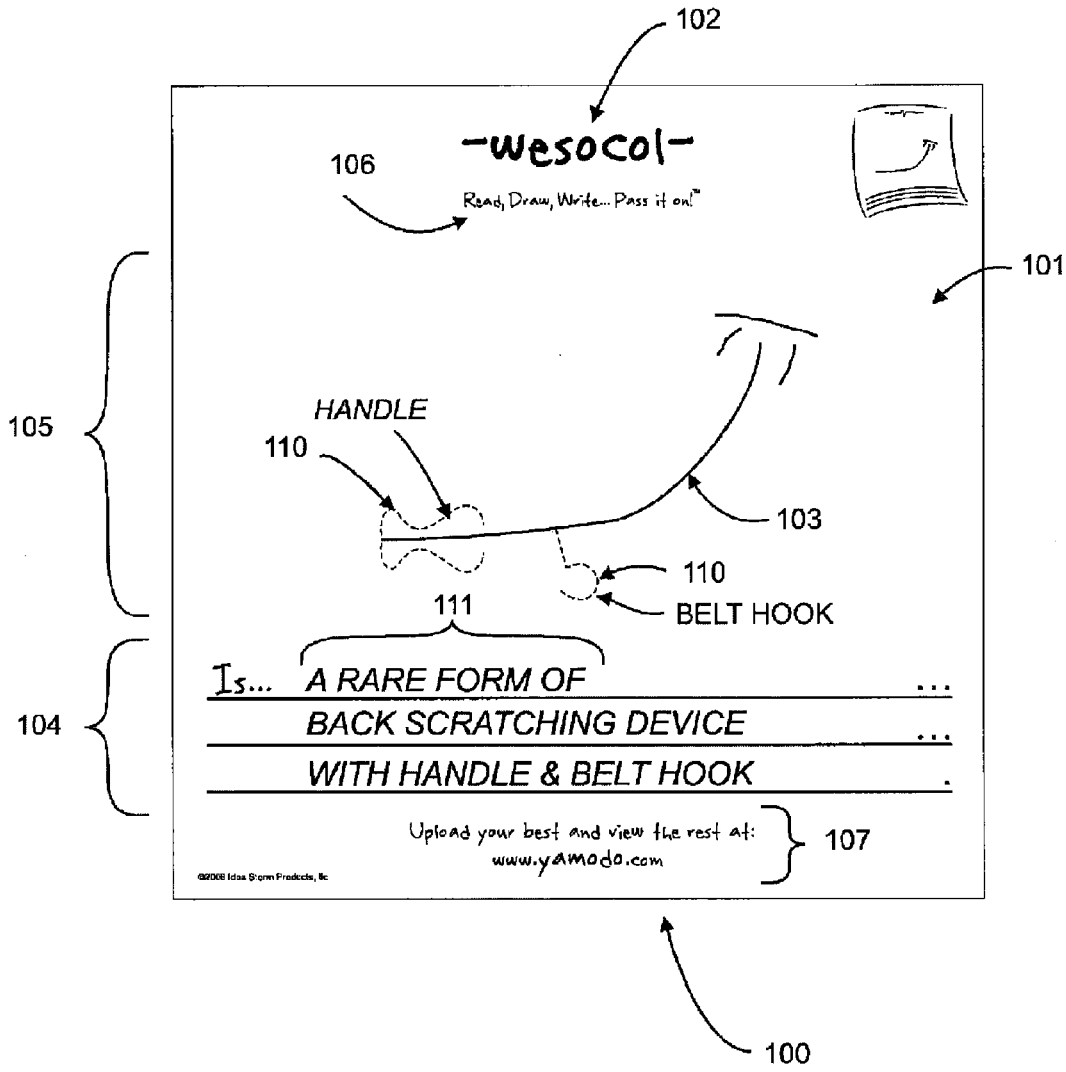
FIG. 1 is an image of a media of participation including a constructed precursor phrase and initial image prior to a user participation.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 2:
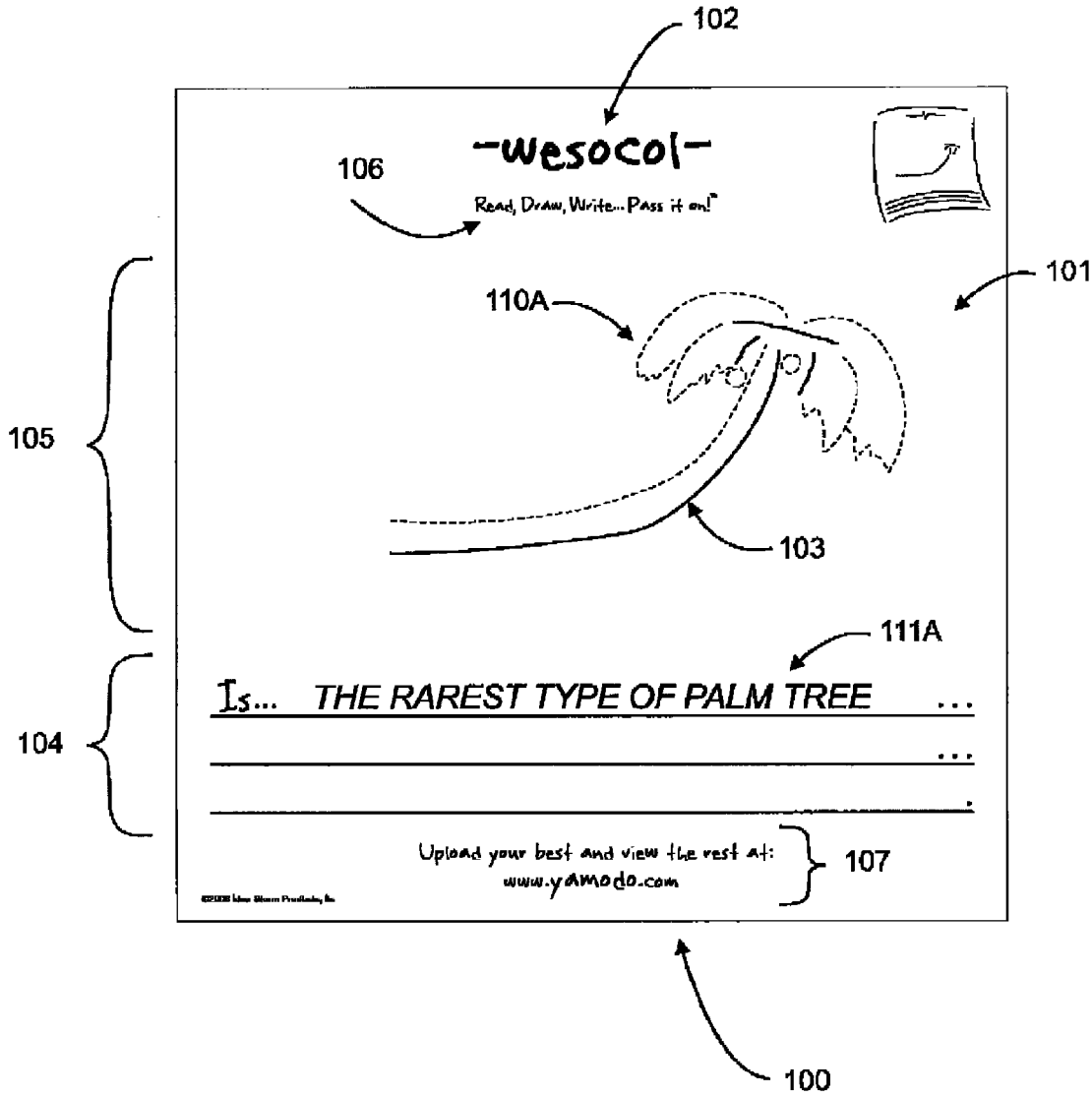
FIG. 2 is an image of FIG. 1 following an initial user participation.
Figure 3:
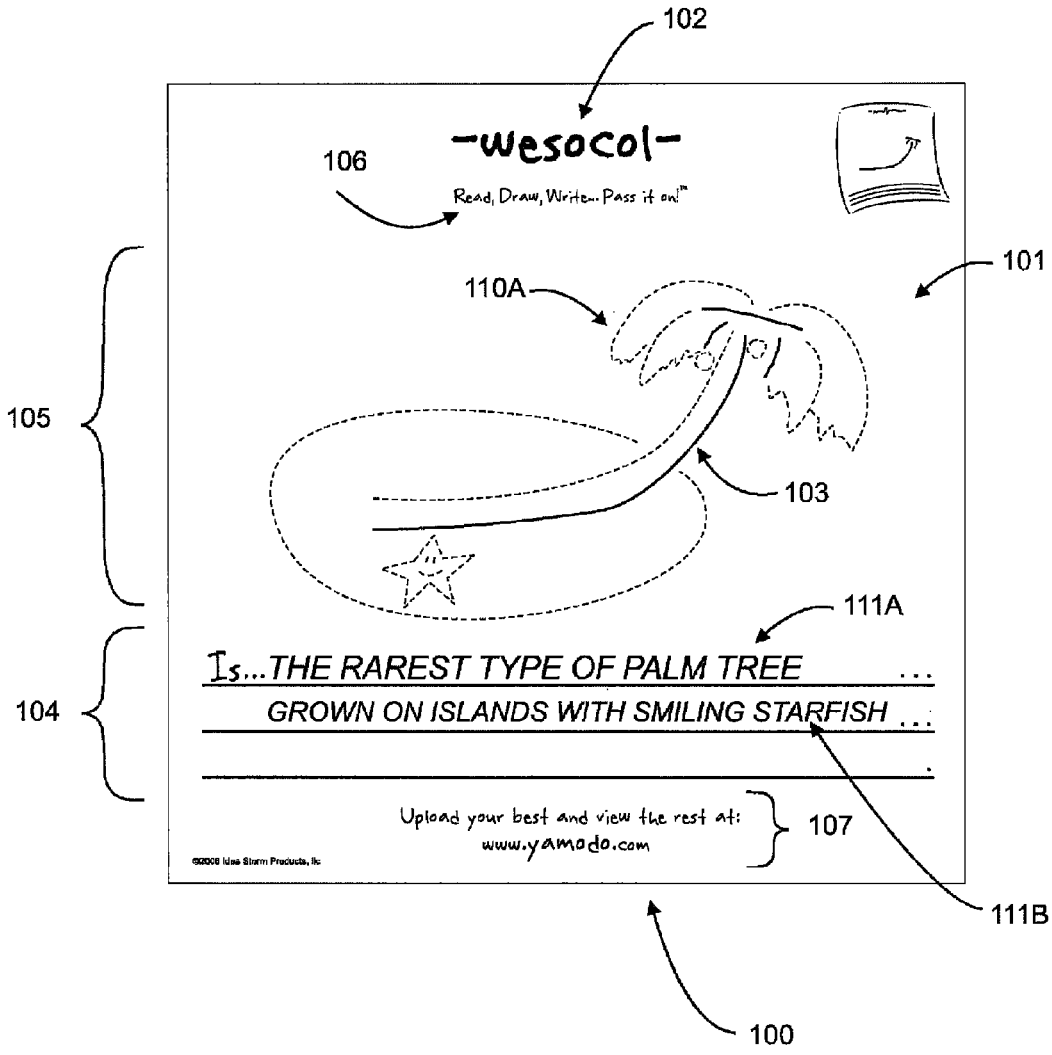
FIG. 3 is an image of FIG. 2 following a further user participation noting completion of the defined visual and lingual result.

Referring now to FIGS. 1-3 an example of a system 100 for interactive entertainment is presented including, on a media for participation 101, at constructed precursor phrase 102, a constructed precursor image portion 103, and a location for the generation of both a visual definition 104 and an image definition 105.

Additionally, a brief review of the entertainment instructions is provided at 106, and an access portal and an interactive instruction 107 is also provided allowing participant-users to upload and compare completed definitional images via an interactive networked or non-networked computer system.

The constructed precursor phrase 102 is selected from non-previously defined words commonly in use in a relevant language. Phrase 102 may also be selected from rarely known but conventionally defined phrases (for example Old English phrases no longer in common use).

During entertainment use, a first user will consider the constructed precursor phrase 102, and the constructed illustration or image portion 103 and generate a visual and language definition. In FIG. 1, a single participant-user example, a single user generates a complete visual and language definition, noted along image region 105 as additional dashed images 110 (adding a handle and belt hook). Additionally, the single participant-user has provided a generated lingual definition 111 along definition region 104, namely "A rare form of back scratching device with handle and belt hook".

In contrast to FIG. 1, FIGS. 2 and 3 involve interactive or pass-it-on type play between a first and a second user, where each user adds a portion of a visual and a lingual definition portion, respectively 111A, 111B, and 110A, 110B, according to the review of FIG. 1.

Figure 4:
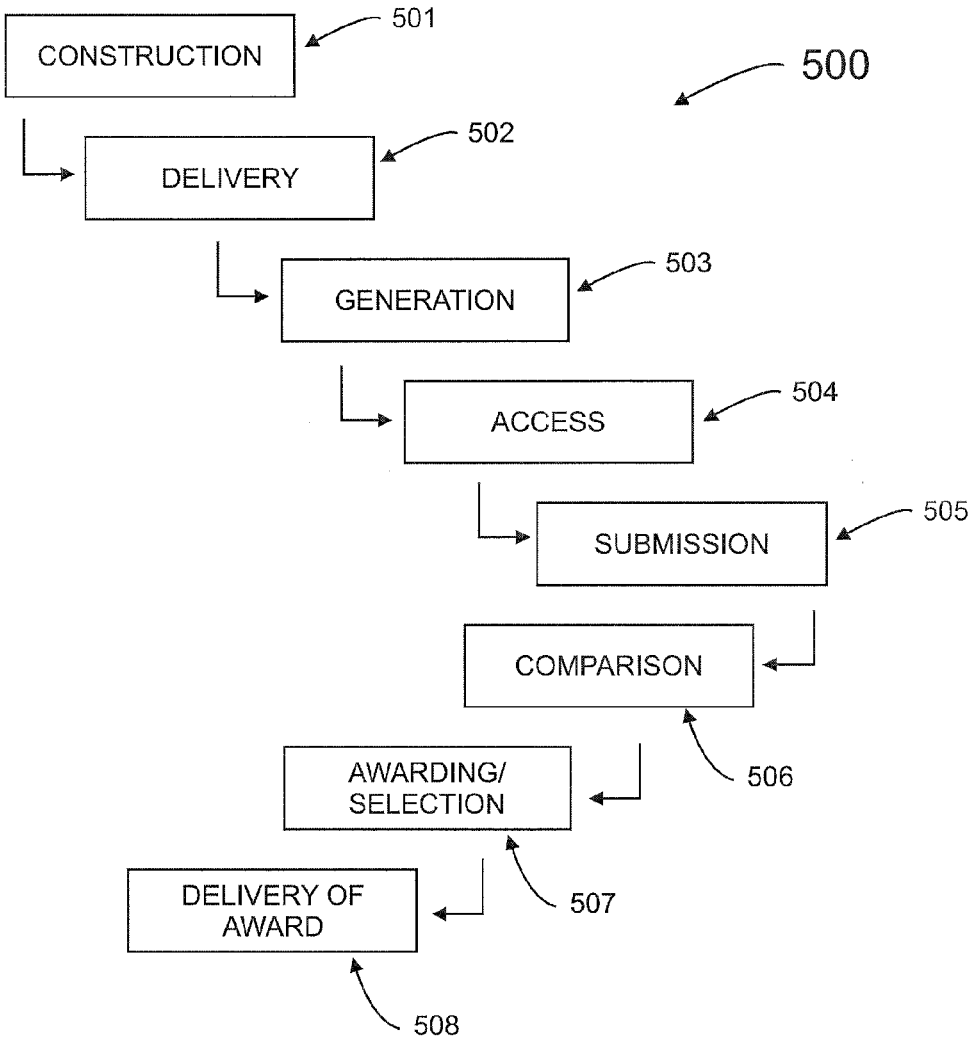
FIG. 4 is a flow chart of an optional single user method for interactive entertainment or single user entertainment system involving an interactive computer network.

Referring now to FIG. 4, a method and system for interactive entertainment is presented at 500, and includes a first step 501 for constructing a precursor phrase and precursor image on a media for participation (for example paper, or a computer screen operated by a computer). A second step 502 is the delivery of the constructed precursor phrase and image to participant-users. Following review by participant-users (single or multiple), the participant users generate a defined visual illustration definition and written lingual definition for the respective constructed precursor phrase and image at step 503.

Following generation step 503, a participant user accesses an interactive computer network (such as the Internet) via access step 504 for submitting 505 the constructed definition to a hosting site where a comparison 506 may be made of previously submitted definitions for the same or different constructed precursor phrases and images.

An additional step conducted by either a hosting service, or by user participation via a popularity selection may be conducted at 507, and an award selection may be made and delivered to a recipient at 508.

It will be recognized that the interactive computer system may be either networked or PC based systems, and may be substituted with a paper based or printed system without exceeding the bounds of the present disclosure.

As an additional detail, it will be recognized that the step of construction 501 may additionally be recognized as including a step of constructing multiple copies (for example one hundred copies each having a specific identifier of "1000A") of the interactive system and of distributing the same to multiple single or multiple users. It will be additionally recognized that during the step of submission and comparison 505, 506, that multiple individual participant-users may identify themselves specifically, and submit respectively differing generated visual and lingual definitions for each specific constructed precursor phrase and image. It this way, it will be recognized, that system or method 500 may provide a plurality of different definitions from different users for comparison step 506 allowing a diverse number of definitions for awarding and selection step 507, without departing from the scope and spirit of the present invention.

Figure 5:
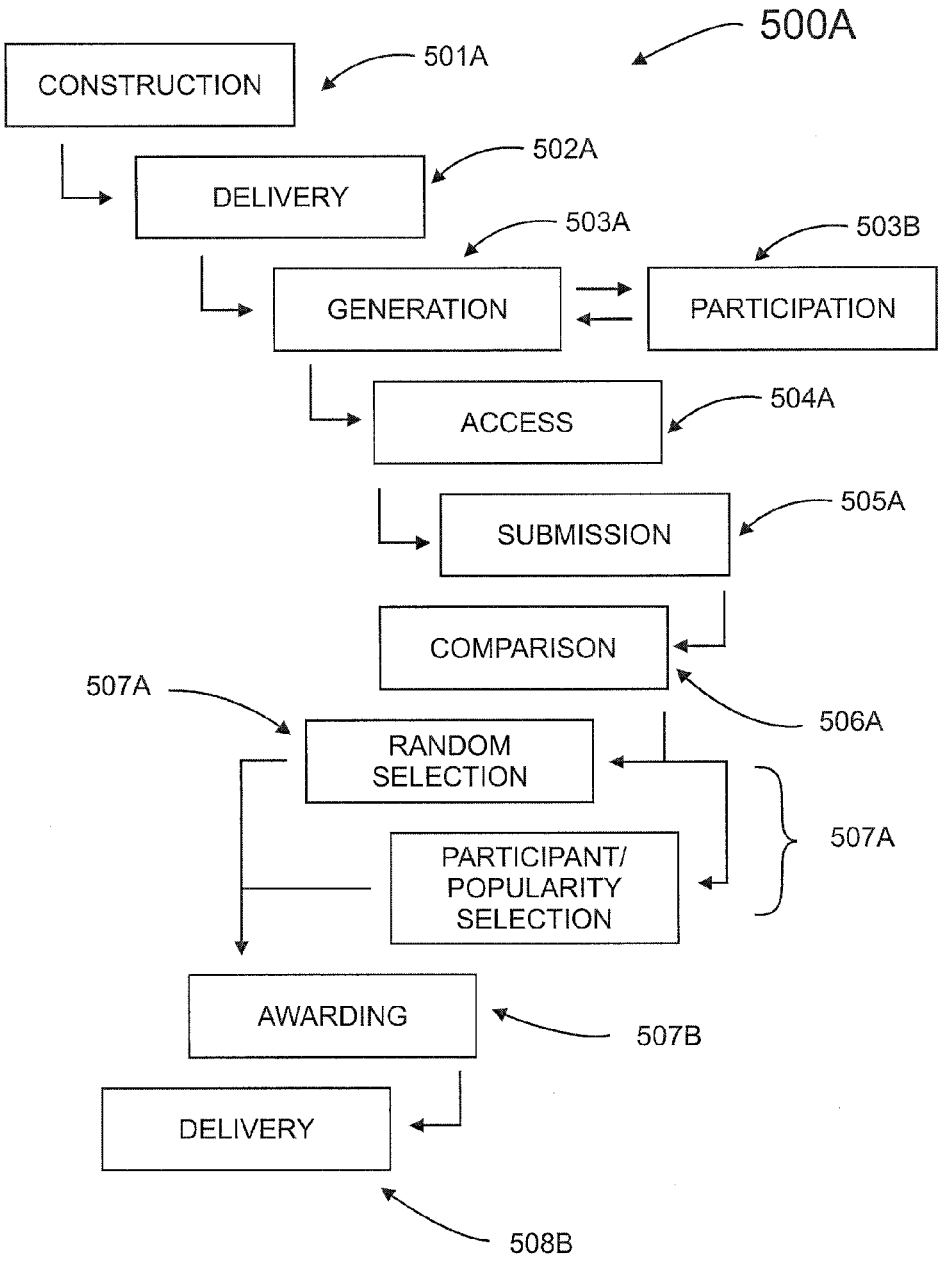
FIG. 5 is a flow chart of a multiple participant-user method for interactive entertainment involving a computer network.

Referring now to FIG. 5, it will be recognized that system 500, and each of the steps in system 500 are represented by similarly respective identifiers 500A, etc. as in FIG. 4 so that no further description is required by those of skill in the gaming arts. However, it is noted that multiple participants at steps 503A-503B are allowed to interact in a "pass-it-on", "pass-it-back" or inter-participation-type format between multiple users, and that the awarding/selecting step is split into a selecting step 507A and awarding step 507B. Selecting step 507A is also split and identified as optional types of selecting steps, such as a random selection step 507A' and popularity selection step 5057A", or both in combination, may be employed to determine a suitable winner or winning team. Consequently, those of skill in the gaming arts will appreciate that either sets of individuals (for example 3 individuals) or sets of teams (for example 3 teams) may be employed to provide the drawing definition and word definition portions of the constructed phrase and constructed image portions without departing from the scope and spirit of the present invention. In this manner, the instructional phrase 106 of "read, draw, write . . . pass it on" may be readily practices for entertaining purposes.

Figure 6:
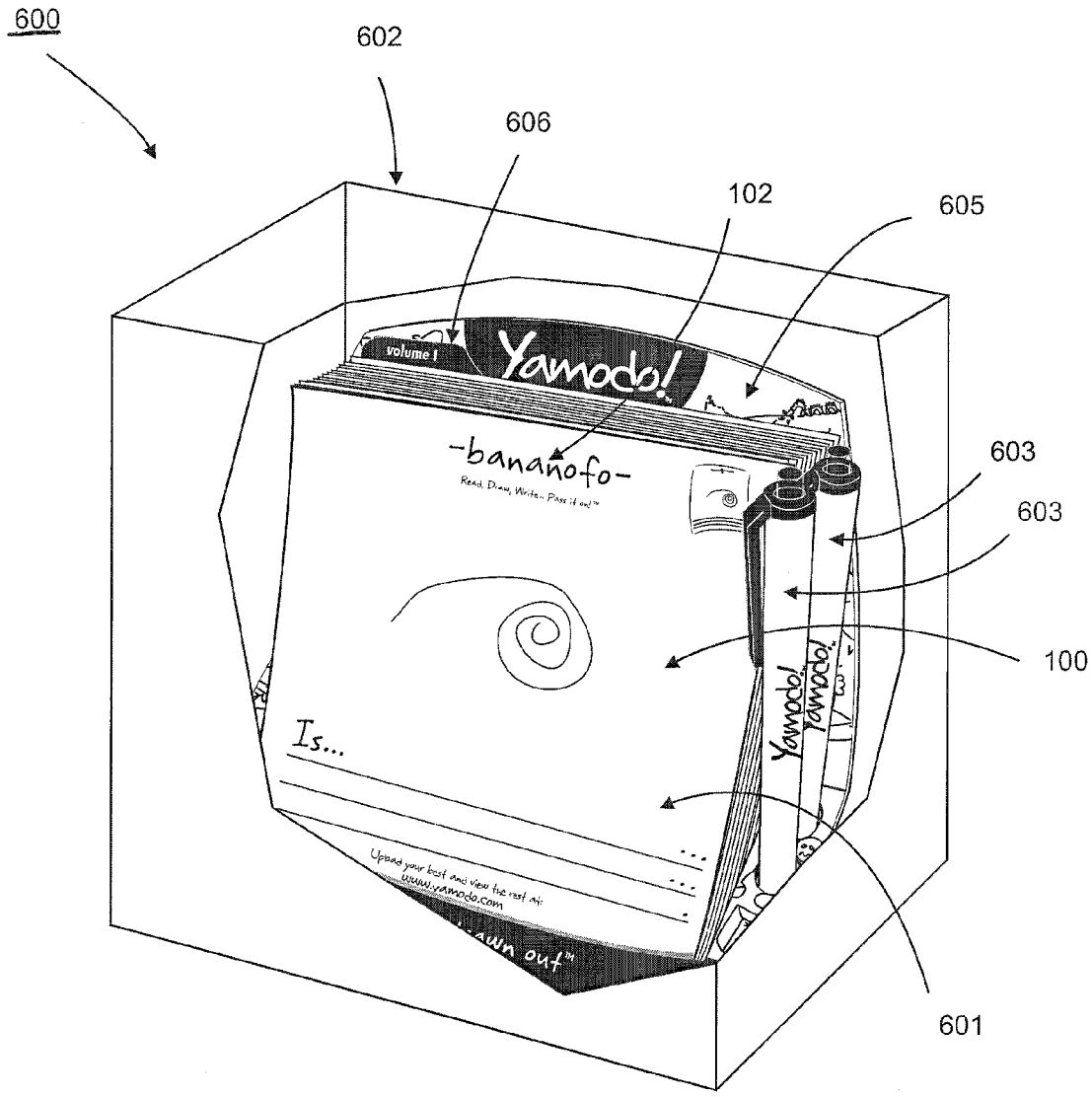
FIG. 6 is a perspective relieved view (cut away view) of a commercial embodiment of the present invention shown as a kit assembly.

Referring now to FIG. 6, a commercial kit embodiment of the present invention 100 is shown retained in a package 602 for delivery and commercial sale. Package 602, contains unit 100 with playing slips 601, as well as drawing pens 603, and a supportive display device 605 containing a particular unit identifier 606, allowing a user to access an on-line submission system (for example www.yamodo.com) to submit completed playing slips 601 with imagined definitions and drawings generated by users for common enjoyment and potentially selective competition between other submitters of definitions for the same precursor constructed phrases and images (for example an award for "goofiest image", or "most politically correct" definition may be given by popular selection).

In this manner, it will be recognized that a plurality of similar packages 602, containing similar playing units 100 may be sold, distributed, and used for interactive entertainment by individuals, family units, commercial establishments etc. Since each playing unit 100 is identified by an identifier (volume number, letter etc.) it is locatable via an on-line host system, and since each generated precursor phrase and image portion is the same for a particular identified playing unit 100, diverse users of similarly identified playing units can compare results for the same phase.

Having discussed the presently preferred embodiment of the playing units based on paper, those of skill in the art will also recognize that additional versions and adaptations of the invention are available without departing from the spirit and scope of the present invention. For example, different versions of the ultimate product may be provided, including but not limited to:

(a) a travel version of reduced size,
(b) a gift-card version for single use;
(c) a calendar version for daily use (for example 365-day calendar with tear-off gum backing or releasable adhesive backing for wall application,
(d) a large poster-sized version for use in displays, stand-up games, or public-venue uses.
(e) a public display version (similar to that shown in FIG. 1), but with the support display stand shown in FIG. 6, for use on countertops, offices entries, etc. to draw attention and entertain while waiting.
(f) a white-board or small-sized erasable ink version where the generated precursor constructed phrase and image portion are of fixed ink and the inclusions/add-ons by others of completing the definition and the image may be erased for a subsequent user.
(g) a team-based version, for example, where similar phrases are employed by separate teams, and each team provides both the definition of the constructed phrase and the completion of the image portion employing a pass-between-team-members process until completion.
(h) an electronic version playable only on-line using known electronic drawing-stylus software, image displays, email links, and site-access software known to those in the on-line electronic game playing arts or provided for individual use on a lap-top computer or other single-user electronic computer device (PDA, etc.),
(i) a partially electronic version were an electronic computer selects previously stored constructed phrases for use for matching with, for example only, a playing slip with an image portion, allowing random association by a device between the image portion and the selected constructed phrase,
(j) a die or dice based board-game-type version wherein, a die or sets of dice are employed to select stored phrases and or select drawing image portions, allowing a type of game play and generation of an increased number of phrase and image portion matches,
(k) a timed-version employing any of the above variants, but also including the use of a timing device to limit a user's time to generate the image or definition, or the time spent by individual players in a team between passing-it-on steps; and
(l) a themed version of any of the above embodiments, wherein the constructed phrases and image portions have a particular theme; for example, a sports theme, a political theme, western theme, an educational theme, a space theme, and a children's story type theme, etc.

Those of skill in the art of developing interactive entertainment and game playing will recognize that while the present description includes more than one embodiment, the description and the invention are not limited thereto, but may be readily adapted to variant entertainment games without departing from the spirit and scope of the present invention. Consequently each of these variant entertainment games shall be considered adapted herein.

As used herein a precursor constructed phrase represents any use of either a single word or multiple word phrase or both on a media for participation such that the precursor constructed phrase is determined prior to an involvement by game participants, either by a system operator, a random phrase generator, or other means known to those in the gaming arts. The use of the word 'precursor' represents the timing of the constructed phrase, namely prior to involvement by game participants. A precursor constructed phrase is preferably an original non-earlier-defined word, for example an arbitrary not-previously-recognized word in any language (not in the dictionary), but the constructed phrase is not restricted to such and may also be a rarely used known word or phrase or a commonly used known word or phrase not yet conventionally defined without departing from the spirit and scope of the present invention.

As used herein, the phrase image portion may represent a line drawing, the use of a 2-dimensional or 3-dimensional visual image, wherein the image may be printed in any tangible medium of express, or may represent an electronic image file that may be a fixed or moving electronic image (for example a *.jpg or *.tiff file image), so that when such an image portion is provided or constructed it may be perceived by a participant-user interacting with the system and methods provided.

As used herein the phrase drawing relates to the generation of a visual depiction or sketch representing an illustration, or a portion of an illustration, of the precursor constructed phrase or an illustration of a portion of the definition of the precursor constructed phrase, and may be conducted physically (with, for example, pencil and paper), or electronically (with, for example, an electronic interactive drawing system).

Similarly, as used herein the phrase writing will be understood by those of skill in the art as being an inclusive phrase, and shall include marking a media with visual indicia either physically or electronically via an interactive computer system, and verbally providing such description to other user-participants, or both, to enable other users, system operators, or participant-users to perceive the intellectually resultant definition.

As used herein the phrase media for participation shall be understood by those of skill in the art as representing any suitable media for interacting between a participant-user and a generated precursor phrase and image portion or between a plurality of participant-users. The media for participation may include, but is not limited to; printed paper media, electronic interaction media, board game media, dice-type game media, calendar media, adhesive pad media, spiral bound media, white-board or erase-board type media, and other forms of media capable of achieve related results.

As used herein the words definition and/or description will be understood to be loosely applied to the generation of an explanation or depiction of the constructed precursor constructed phrase.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A method for interactive entertainment of at least one participant-user, comprising the steps of:

providing a precursor constructed phrase and an image portion on a media for participation;

reading said precursor constructed phrase;

generating a definition of said precursor constructed phrase; and said step of generating said definition further comprising the steps of:

drawing at least a visual illustration of said definition including said image portion; and writing at least a first portion of said definition of said precursor constructed phrase, wherein said steps of drawing and writing are linked to depict said definition of said precursor constructed phrase providing an interactive computer system having a centralized platform for hosting a plurality of definitions of said precursor constructed phrases from a plurality of different participant-users;

accessing said interactive computer system; submitting at least one of said plurality of definitions of said precursor constructed phrase to said centralized platform; and enabling an access to said submitted at least one definition.

2. A method for interactive entertainment, according to claim 1, further comprising the step of:

providing a means for selecting a preferred definition of said precursor constructed phrase among said plurality of definitions; and said means for selecting including at least one of a means for participant-user popularity selection and a means for random participant-user selection.

3. A method for interactive entertainment, according to claim 2, further comprising the step of:

providing a means for delivering an award to said participant-user who submitted said preferred definition of said precursor constructed phrase according to said means for selecting.

4. A method for interactive entertainment, according to claim 1, wherein:

said steps of reading said precursor constructed phrase and generating said definition of said precursor constructed phrase includes at least two participant-users.

5. A method for interactive entertainment, according to claim 4, wherein:

said step of drawing further comprises:

at least a first step of drawing at least a portion of said illustration by said at least one participant-user as a first user and at least a second step of drawing a second portion of said illustration by said at least second participant-user; whereby said method for interactive entertainment enables use by multiple participant-users.

6. A method for interactive entertainment, according to claim 4, wherein:

said step of writing further comprises:

at least a first step of writing said at least first portion of said definition by said at least one participant-user as a first user and at least a second step of writing at least a second portion of said definition by said at least second participant-user; whereby said method for interactive entertainment enables use by multiple participant-users.

7. A method for interactive entertainment, according to claim 1, wherein:

said step of generating said definition of said precursor constructed phrase includes at least two participant-users;

said step of writing further comprises:

at least a first step of writing said at least first portion of said definition by said at least one participant-user as a first user and at least a second step of writing at least a second portion of said definition by said at least second participant-user; and at least a first step of drawing at least a portion of said illustration by said at least one participant-user as a first user and at least a second step of drawing a second portion of said illustration by said at least second participant-user; whereby said method for interactive entertainment enables use by multiple participant-users.

8. A method for interactive entertainment, according to claim 1, wherein:

said media for participation comprises at least one of a written pad, a printed paper pad, a non-networked electronic memory device, and a networked electronic memory device.

9. A method for interactive entertainment of at least one participant-user, comprising the steps of:

providing a precursor constructed phrase and an image portion on a media for participation;

reading said precursor constructed phrase;

generating a definition of said precursor constructed phrase;

said step of generating said definition further comprising the steps of:

drawing at least an illustration of said definition including said image portion; and writing at least a first portion of said definition of said precursor constructed phrase, wherein said steps of drawing and writing are linked to depict said definition of said precursor constructed phrase;

providing an interactive computer system having a centralized platform for hosting at least one of a plurality of definitions of said precursor constructed phrases said participant-users;

accessing said interactive computer system;

submitting at least one of said plurality of definitions of said precursor constructed phrase to said centralized platform; and enabling an access to said submitted at least one definition for at least a visual review.

10. A method for interactive entertainment, according to claim 9, wherein:

said step of generating said definition of said precursor constructed phrase includes at least two participant-users.

11. A method for interactive entertainment, according to claim 9, wherein:

said step of drawing further comprises:

at least a first step of drawing at least a portion of said illustration by said at least one participant-user as a first user and at least a second step of drawing a second portion of said illustration by said at least second participant-user following a passing of said media for participation to said first user; whereby said method for interactive entertainment enables use by multiple participant-users.

12. A method for interactive entertainment, according to claim 10, wherein:

said step of writing further comprises:

at least a first step of writing said at least first portion of said definition by said at least one participant-user as a first user and at least a second step of writing at least a second portion of said definition by said at least second participant-user; whereby said method for interactive entertainment enables use by multiple participant-users.

13. A method for interactive entertainment, according to claim 9, wherein:

said step of generating said definition of said precursor constructed phrase includes at least two participant-users;

said step of writing further comprises:

at least a first step of writing said at least first portion of said definition by said at least one participant-user as a first user and at least a second step of writing at least a second portion of said definition by said at least second participant-user; and at least a first step of drawing at least a portion of said illustration by said at least one participant-user as a first user and at least a second step of drawing a second portion of said illustration by said at least second participant-user; whereby said method for interactive entertainment enables use by multiple participant-users.

14. A system for interactive entertainment of at least one participant-user, comprising:

means for generating a precursor constructed phrase and an image portion on a media for participation;

means for reading said precursor constructed phrase by said at least one participant-user;

means for generating a definition of said precursor constructed phrase;

said means for generating said definition further comprising:

means for drawing at least an illustration of said definition including said image portion; and means for writing at least a first portion of said definition of said precursor constructed phrase, wherein said means for drawing and writing are linked to depict said definition of said precursor constructed phrase; means for providing an interactive computer system having a centralized platform for hosting a plurality of definitions of said precursor constructed phrases from a plurality of different participant-users; means for accessing said interactive computer system; means for submitting at least one of said plurality of definitions of said precursor constructed phrase to said centralized platform; and means enabling an access to said submitted at least one definition.

15. A system for interactive entertainment, according to claim 14, further comprising:

means for selecting a preferred definition of said precursor constructed phrase among said plurality of definitions; and said means for selecting including at least one of a means for participant-user popularity selection and a means for random participant-user selection.

* * * * *